US009250644B2

(12) United States Patent
Su et al.

(10) Patent No.: US 9,250,644 B2
(45) Date of Patent: Feb. 2, 2016

(54) POWER CONVERSION SYSTEM

(71) Applicant: Sitronix Technology Corp., Hsinchu County (TW)

(72) Inventors: Chung-Hsin Su, Hsinchu County (TW); Tsun-Sen Lin, Hsinchu County (TW)

(73) Assignee: Sitronix Technology Corp., Jhubei, Hsinchu County (TW)

( * ) Notice: Subject to any disclaimer, the term of this patent is extended or adjusted under 35 U.S.C. 154(b) by 143 days.

(21) Appl. No.: 14/281,852

(22) Filed: May 19, 2014

(65) Prior Publication Data

US 2015/0261244 A1 Sep. 17, 2015

(30) Foreign Application Priority Data

Mar. 12, 2014 (TW) ..... 103108742

(51) Int. Cl.

| | |
|---|---|
| ***G05F 3/02*** | (2006.01) |
| ***G09G 5/00*** | (2006.01) |
| ***G09G 5/18*** | (2006.01) |
| ***G09G 3/36*** | (2006.01) |

(52) U.S. Cl.

CPC ..... *G05F 3/02* (2013.01); *G09G 3/3696* (2013.01); *G09G 5/00* (2013.01); *G09G 5/18* (2013.01); *G09G 2330/021* (2013.01)

(58) Field of Classification Search

CPC ..... G09G 2330/021; G09G 2330/02; G09G 3/3696

See application file for complete search history.

(56) References Cited

U.S. PATENT DOCUMENTS

| | | | | |
|---|---|---|---|---|
| 5,930,127 | A * | 7/1999 | Iwahori | H02M 1/425 315/247 |
| 2002/0089369 | A1* | 7/2002 | Ikeda | H02M 3/07 327/536 |
| 2005/0030776 | A1* | 2/2005 | Lin | H02M 7/523 363/98 |
| 2007/0263419 | A1 | 11/2007 | Sasaki | |
| 2012/0025720 | A1* | 2/2012 | Chen | H02M 3/337 315/185 R |
| 2012/0286717 | A1* | 11/2012 | Fukuta | B60L 11/123 318/722 |
| 2013/0069614 | A1* | 3/2013 | Tso | H02M 3/07 323/288 |
| 2013/0293807 | A1* | 11/2013 | Kasuga | G02F 1/133 349/61 |
| 2015/0077073 | A1* | 3/2015 | Yu | H02M 3/1584 323/271 |

FOREIGN PATENT DOCUMENTS

| | | |
|---|---|---|
| CN | 101071977 A | 11/2007 |
| TW | 201214375 | 4/2012 |

* cited by examiner

*Primary Examiner* — Ricardo L Osorio
(74) *Attorney, Agent, or Firm* — Winston Hsu; Scott Margo

(57) ABSTRACT

A power conversion system in an electronic device is utilized for converting an input voltage of a power source terminal to a required voltage of a load circuit to provide power to the load circuit. The power conversion system includes a first voltage conversion circuit for converting the input voltage to the required voltage of the load circuit according to a first control signal; and a power control module for generating the first control signal according to a starting signal or a load voltage of the load circuit; wherein the load circuit receives the voltage outputted from the first voltage conversion circuit to perform operations.

14 Claims, 7 Drawing Sheets

POWER CONVERSION SYSTEM

BACKGROUND OF THE INVENTION

1. Field of the Invention

The present invention relates to a power conversion system in an electronic device, and more particularly, to a power conversion system capable of rapidly outputting a power with a stable voltage value via combining voltage conversion circuits with different features.

2. Description of the Prior Art

Generally, all electronic devices equip with power conversion systems for converting a voltage of an external power to a workable voltage of the load circuit. For example, a liquid-crystal display (LCD) may equip with a charge pump for converting the voltage of the external power (e.g. 2.8 volts) to a voltage capable of driving the internal display components (e.g. 6 volts or 15 volts) and outputting the converted voltage to the source driver and the gate driver to drive the display components of the display panel to display different brightness.

Moreover, the voltage conversion circuits have different features due to different circuit structures. For example, the charge pump is a capacitor type booster. When the output loading is smaller, the voltage value of the output voltage of the capacitor type booster is more stable (i.e. the ripple of the output voltage is smaller). However, the capacitor type booster needs more time for increasing the voltage value of the external power to the workable voltage due to the small output current. In addition, the inductor type booster has the greater output current to drive the load circuit and can rapidly increase the voltage to the workable voltage of the load circuit. However, the voltage value of output voltage of the inductor type booster is more unstable (i.e. the ripple of the output voltage is greater).

In such a condition, since the prior art only configures a single kind of voltage converting circuit to convert the power required by the load circuit in the electronic device, the power with workable and stable voltage value cannot be outputted to the load circuit due to the features of the power conversion circuit. Thus, how to rapidly provide the power with the stable voltage value to the load circuit becomes a topic to be discussed.

SUMMARY OF THE INVENTION

In order to solve the above problem, the present invention provides a power conversion system for an electronic device. The power conversion system combines voltage conversion circuits with different features and is capable of rapidly outputting a power with a stable voltage value.

The present invention discloses a power conversion system in an electronic device, for converting an input voltage of a power source terminal to a required voltage of a load circuit to provide power to the load circuit, the power conversion system comprising a first voltage conversion circuit, coupled to the power source terminal for converting the input voltage to the required voltage of the load circuit according to a first control signal; and a power control module, coupled to the first voltage conversion circuit and the load circuit for generating the first control signal according to a starting signal turning on the load circuit or a load voltage of the load circuit; wherein the load circuit is coupled to the first voltage conversion circuit, receives the voltage outputted from the first voltage conversion circuit to perform operations, and outputs the load voltage to the power control module.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
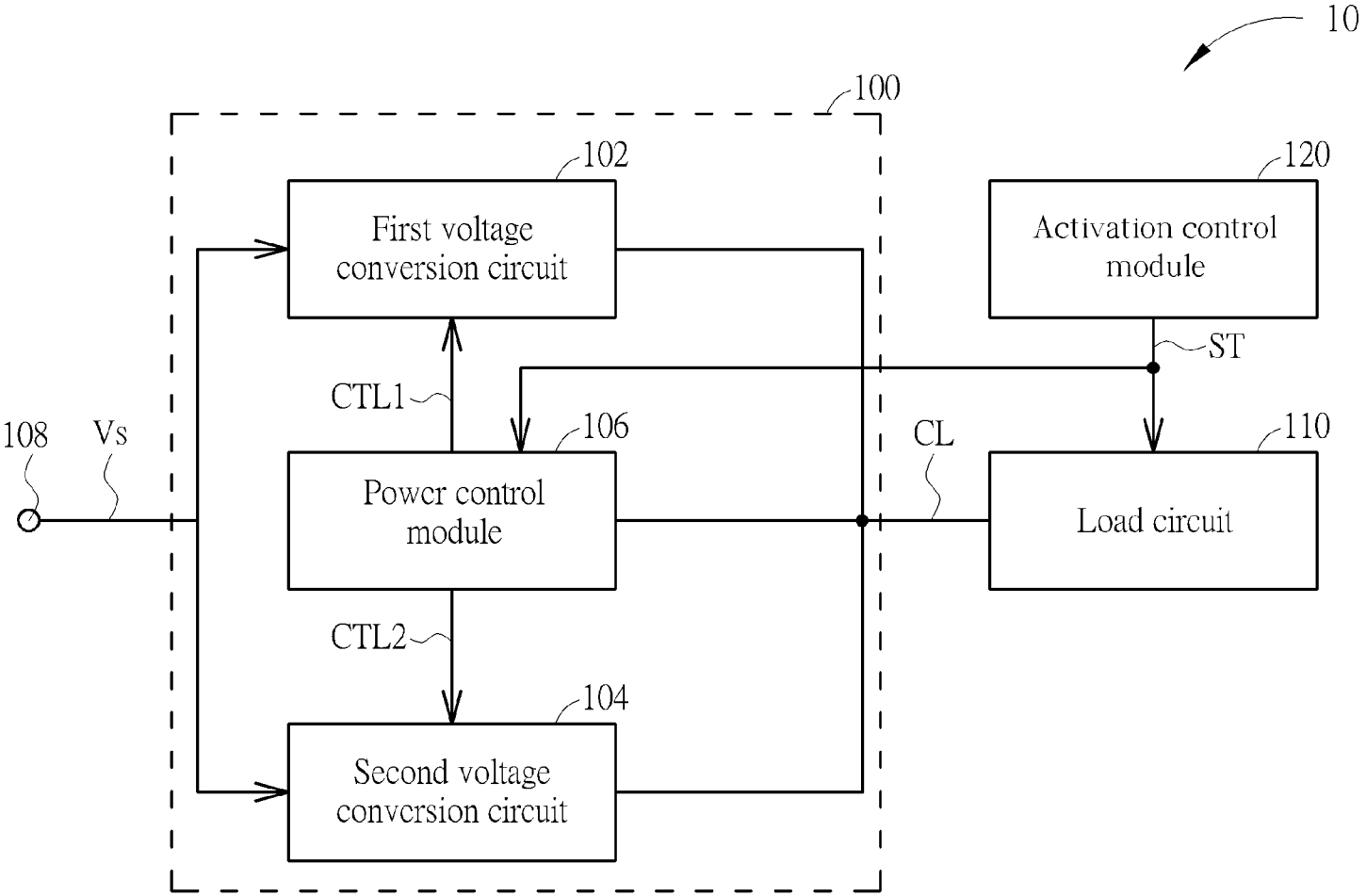
FIG. 1 is a schematic diagram of an electronic device according to an embodiment of the present invention.

Please refer to FIG. 1, which is a schematic diagram of an electronic device 10 according to an embodiment of the present invention. As shown in FIG. 1, the electronic device 10 comprises a power converting system 100, a load circuit 110 and an activation control module 120. The electronic device 10 may be a display panel device, a smart phone, a smart TV or a tablet and is coupled to a power source terminal 108. The electronic device 10 converts an input voltage Vs transmitted from the power source terminal 108 to a workable voltage of the load circuit 110 via the power conversion system 100, to provide the power required by operations of the load circuit. In addition, the electronic device 10 generates a starting signal ST via the activation control module 120, to control the load circuit 110 whether to start performing the operations. For example, the electronic device 10 generates the starting signal ST with a high voltage level to control the load circuit to start performing the operations and generates the starting signal ST with a low voltage level to control the load circuit 110 to stop performing the operations.

In details, the power conversion system 100 is coupled to the power source terminal 108 and comprises a first voltage conversion circuit 102, a second voltage conversion circuit 104 and a power control module 106. The first voltage conversion circuit 102 and the second voltage conversion circuit 104 may be the charge pumps, the inductor type booster or the boosters of other type, and is not limited herein. The first voltage conversion circuit 102 and the second voltage conversion circuit 104 are utilized for converting the voltage value of the input voltage Vs to the workable voltage value of the load circuit 110 and jointly connecting the converted voltages to a circuit wire CL to transmit the converted voltages to the load circuit 110.

The load circuit 110 determines whether to start performing the operations according to the starting signal ST and receives the voltages converted by the first voltage conversion circuit 102 and the second voltage conversion circuit 104 through the circuit wire CL for performing the operations. For example, when the electronic device 10 is a display panel, the activation control module 102 generates the starting signal ST according to scan line signals of the electronic device 10 for controlling a gate driving circuit of the load circuit 110 to start performing operations, so as to conduct transistor switches of the display components. Next, the activation control module 120 generates the starting signal ST according to data line signals of the electronic device 10 for controlling the source driving circuit of the load circuit 110 to start performing operations, so as to charge capacitors of the display components, such that the display components shows corresponding brightness.

The power control module 106 is coupled to the first voltage conversion circuit 102, the second voltage conversion circuit 104, the load circuit 110 and the activation control module 120. The power control module 106 receives the starting signal ST from the activation control module 120 and a load voltage Vo of the load circuit 110 from the circuit wire CL. The load voltage Vo is a voltage of an internal loading in the load circuit 110 and varies with the currents outputted from the first voltage conversion circuit 102 and the second voltage conversion circuit 104 and the impedance of the internal loading in the loading circuit 110. The power control module 106 generates a first control signal CTL1 and a second control signal CTL2 according to the starting signal ST and the magnitude of the loading voltage Vo, to control the first voltage conversion circuit 102 and the second voltage conversion circuit 104 whether to convert the input voltage Vs and to determine whether to provide the voltage converted by the first voltage conversion circuit 102 or the second voltage conversion circuit 104 to the loading circuit 110 via the circuit wire CL.

Preferably, the first voltage conversion circuit 102 is the inductor type booster and the second voltage conversion circuit 104 is a charge pump of the capacitor type booster. Since the inductor type booster features a great output current and the capacitor type booster features a stable output voltage value, the power control module 106 first controls the first voltage conversion circuit 102 (i.e. the inductor type booster) to convert the input voltage Vs according to the starting signal ST or the magnitude of the load voltage Vo, for quickly providing the voltage required by the operations of the load circuit 110. Next, the power control module 106 controls the first voltage conversion circuit 102 (i.e. the inductor type booster) to stop performing the operations and controls the second voltage conversion circuit 106 (i.e. the capacitor type booster) to start performing the operations under appropriate conditions, for making the load circuit 110 to receive the voltage, which is outputted by the second voltage conversion circuit 106 (i.e. the capacitor type booster) and has a stable voltage value, for performing the operations. Please note that, the power control module 106 may first control the first voltage conversion circuit 102 and the second voltage conversion circuit 104 to output the converted voltages, simultaneously, for making the load circuit 110 to receive a greater current and to rapidly acquire the voltage required by normal operations. Under the appropriate conditions, the power control module 106 controls the first voltage conversion circuit 102 to stop performing the operations, to make the load circuit 110 to receive the voltage, which is outputted by the second voltage conversion circuit 102 and has stable voltage value, for performing the operations.

In other words, the power conversion system 100 appropriately determines the timings of the first voltage conversion circuit 102 and the second voltage conversion circuit performing the operations according to the starting signal ST or the magnitude of the load voltage Vo, for combining the voltage conversion circuits with different features, so as to provide the power with stable voltage value to the load circuit 110 quickly.

According to different applications and design concepts, the timing of the power control module 106 controlling the first voltage conversion circuit 102 and the second voltage conversion circuit 104 to start performing operations or to stop performing operations according to the starting signal ST and the voltage value of the load voltage Vo can be appropriately changed. In a first embodiment, the power control module 106 controls the first voltage conversion circuit 102 to start performing operations according to the starting signal ST and controls the first voltage conversion circuit 102 to stop performing operations according to the starting signal ST. In details, when the starting signal ST does not activate the load circuit 110, the power control module 106 generates the first control signal CTL1 with the low voltage level for controlling the first voltage conversion circuit 102 not to perform the operations according to the starting signal ST. When the starting signal ST activates the load circuit 110 at a time T_S, the power control module 106 learns that the load circuit 110 is about to be activated according to the starting signal ST and generates the first control signal CTL1 with the high voltage level for controlling the first voltage conversion circuit 102 to convert the input voltage Vs to the required voltage of the load circuit 110. After a period, the power control module 106 generates the first control signal CTL1 with the low voltage level at a time T_E, for controlling the first voltage conversion circuit 102 to stop performing the operations. Before the power control module 106 controls the first voltage conversion circuit 102 to stop performing the operations, the power control module 106 generates the second control signal CTL2 with the high voltage level for controlling the second voltage conversion circuit 104 to convert the input voltage Vs to the required voltage of the load circuit 110. In such a condition, the first voltage conversion circuit 102 and the second voltage conversion circuit 104 output the converted voltages to the load circuit 110 simultaneously.

Note that, the power control module 106 controls the second voltage conversion circuit 104 to start performing operations before the time T_E (i.e. before controlling the first voltage conversion circuit 102 to stop performing the operations). For example, the power control module 106 may continuously generate the second control signal CTL2 with the high voltage level, to control the second voltage conversion circuit 106 to perform the operations. In addition, the power control module 106 may generate the second control signal CTL2 with the low voltage level to control the second voltage conversion circuit 104 not to perform the operations when the stating signal ST does not activate the load circuit 110 and generates the second control signal CTL2 with the high voltage level to control the second voltage conversion circuit 104 to start performing the operations before the time T_E. Furthermore, the power control module 106 may generate the second control signal CTL2 with the high voltage level for controlling the second voltage conversion circuit 104 to start performing operations at the time T_E. As long as the timing of controlling the second voltage conversion circuit 104 to start performing operations is before the first voltage conversion circuit 102 stops performing operations, the timing of the power control module 106 controlling the second voltage conversion circuit 104 to start performing operations can be appropriately changed according to different requirements.

Apart from controlling the second voltage conversion circuit 104 to start performing operations before the time T_E (i.e. before controlling the first voltage conversion circuit 102 to stop performing operations), the power control module 106 may control the second voltage conversion circuit 104 to start performing operations when determining the voltage value of the load voltage Vo of the load circuit 110 is greater than a predetermined value VAL. The predetermined value VAL may be appropriately set to make the second voltage conversion circuit 104 to start performing operations before the first voltage conversion circuit 102 stops performing operations, such that the second voltage conversion circuit 102 continuously outputs the voltage to the load circuit 110. The predetermined value VAL can be altered according to different requirements, and is not limited herein.

In the first embodiment, the first voltage conversion circuit 102 is the inductor type booster and the second voltage conversion circuit 104 is the charge pump. The power control module 106 learns that the load circuit 110 is about to be activated according to the starting signal ST and appropriately controls the first voltage conversion circuit 102 to start performing the operations at the time T_S, to provide the required voltage to the load circuit 110 quickly via utilizing the feature of the great output current of the first voltage conversion circuit 102. Next, the power control module 106 appropriately controls the first voltage conversion circuit 102 to stop performing the operations at the time T_E and controls the second voltage conversion circuit 104 to start performing the operations before the first voltage conversion circuit 102 stops performing the operations or when the voltage value of the load voltage Vo is greater than the predetermined value VAL, to provide the voltage with more stable voltage value to the load circuit 110. That is, the power control module 106 appropriately combines the features of the first voltage conversion circuit 102 and the second voltage conversion circuit 104, to quickly provide the power with the stable voltage value to the load circuit 110.

In a second embodiment, after the power control module 106 controls the first voltage conversion circuit 102 to start performing the operations at the time T_S (the details can be referred to the above embodiment and are not described herein for brevity), the power control module 106 controls the first voltage conversion circuit 102 to stop performing the operations when determining the voltage value of the load voltage Vo is greater than the predetermined value VAL. The power control module 106 first controls the first voltage conversion circuit 102 (i.e. the inductor type booster) to provide the required voltage to the load circuit quickly and controls the first voltage conversion circuit 102 to stop performing operations when the magnitude of the load voltage Vo is great enough for allowing the load circuit 110 to normally operate (i.e. when the voltage value of the load voltage Vo is greater than the predetermined value VAL). Before the first voltage conversion circuit 102 stops performing the operations or when the load voltage Vo is greater than the predetermined value VAL, the power control module 106 controls the second voltage conversion circuit 102 (i.e. the capacitor type booster) to start performing the operations, to allow the load circuit 110 to receive the voltage, which has the stable voltage value and is outputted by the second voltage conversion circuit 102.

In a third embodiment, when the starting signal ST has activated the load circuit 110, the power control module 106 controls the first voltage conversion circuit 102 to start performing the operations when determining the voltage value of the load voltage Vo is smaller than the predetermined value VAL. Next, the power control module 106 controls the first voltage conversion circuit 102 to stop performing the operations at the time T_E according to the starting signal ST (the detail operations can be referred to the above embodiments and are not narrated herein for brevity). In the third embodiment, when the voltage value of the load voltage Vo is too small and is required to be increased to the workable voltage rapidly, the power control module 106 controls the first voltage conversion circuit 102 (i.e. the inductor type booster) to quickly provide the required voltage to the load circuit 110. After the voltage value of the load voltage Vo reaches the workable voltage of the load circuit 110, the power control module 106 controls the first voltage conversion circuit 102 to stop performing the operations at the time T_E and controls the second voltage conversion circuit 102 (i.e. the capacitor type booster) to start performing the operations before the first voltage conversion circuit 102 stops performing the operations or when the voltage value of the load voltage Vo is greater than the predetermined value VAL, so as to allow the load circuit 110 to receive the voltage which has more stable voltage value and is outputted by the second voltage conversion circuit 104.

In a fourth embodiment, the power control module 106 refers to the third embodiment to control the first voltage conversion circuit 102 to start performing the operations according to the voltage value of the load voltage Vo and refers to the second embodiment to control the first voltage conversion circuit to stop performing the operations according to the voltage value of the load voltage Vo. The detail operations can be referred to the above embodiments and are not narrated herein for brevity. When the voltage value of the load voltage Vo is too small and is required to be increased to the workable voltage rapidly, the power control module 106 first controls the first voltage conversion circuit 102 (i.e. the inductor type booster) to provide the required voltage to the load circuit 110. After the voltage value of the load voltage Vo reaches the workable voltage of the load circuit 110, the power control module 106 controls the first voltage conversion circuit 102 to stop performing the operations and controls the second voltage conversion circuit 104 (i.e. the capacitor type booster) to start performing the operations before the first voltage conversion circuit 102 stops performing the operations or when the voltage value of the load voltage Vo is greater than the predetermined value VAL, to allow the load circuit 110 to receive the voltage outputted by the second voltage conversion circuit 104 and having the stable voltage value.

Figure 2:
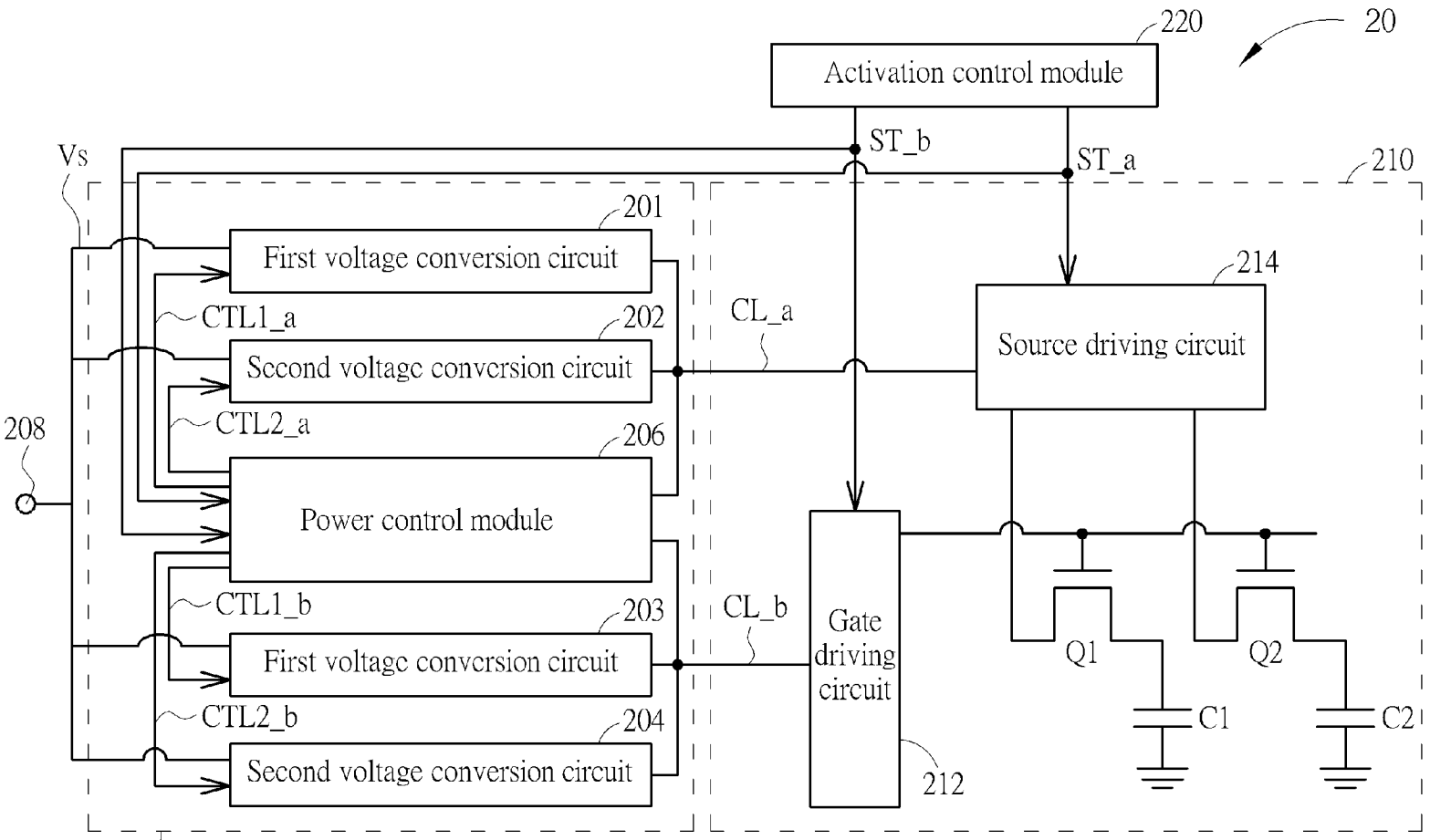
FIG. 2 is a schematic diagram of an electronic device according to another embodiment of the present invention.

According to different requirements, the number of voltage conversion circuit in the power conversion system 100 may be appropriately changed. Please refer to FIG. 2, which is a schematic diagram of an electronic device 20 according to another embodiment of the present invention. As shown in FIG. 2, the electronic device 20 comprises a power conversion system 200, a load circuit 210 and an activation control module 220. The power conversion system 200 comprises first voltage conversion circuits 201, 203, second voltage conversion circuits 202, 204 and a power control module 206. The load circuit 210 comprises a gate driving circuit 212, source driving circuit 214, transistors Q1 and Q2 and capacitors C1 and C2. The electronic device 20 may be a display panel device, the transistors Q1 and Q2 are switches of the display components of the display panel device and the capacitors C1 and C2 represent the capacitor between the two substrates of the display components. The gates and the sources of the transistors Q1 and Q2 are coupled to the gate driving circuit 212 and the source driving circuit 214 respectively. The electronic device 20 may conduct the transistors Q1 and Q2 via the gate driving circuit 212 and charge the capacitors C1 and C2 via the source driving circuit 214 through the source the transistors Q1 and Q2, to control the display components to show different brightness.

In the electronic device 20, the first voltage conversion circuit 201 and the second voltage conversion 202 convert an input voltage Vs of a power source terminal 208, respectively, and output the converted voltages to the source driving circuit 214 via a circuit wire CL_a. The first voltage conversion circuit 203 and the second voltage conversion 204 convert the input voltage Vs of the power source terminal 208, respectively, and output the converted voltage to the gate driving circuit 212 via a circuit wire CL_b. The activation control module 220 generates a starting signal ST_b according to scan line signals of the electronic device 20, for controlling the gate driving circuit 212 to conduct the transistors Q1 and Q2. Next, the activation control module 220 generates a starting signal ST_a according to data line signals of the electronic device 20, for controlling the source driving circuit 214 to charge the capacitors C1 and C2 to the voltages corresponding to display data, so as to control the display components to display corresponding brightness.

Preferably, the first voltage conversion circuits 201 and 203 are the inductor type boosters and the second voltage conversion circuit 202 and 204 are the charge pumps. According to the above embodiments, the power control module 206 may appropriately control the first voltage conversion circuit 203 and the second voltage conversion circuit 204 whether to perform the operations according to the starting signal ST_b or a load voltage Vo_b of the gate driving circuit 212, to combine the voltage conversion circuits with different features, to provide the power with stable voltage value to the gate driving circuit 212, rapidly, and to allow the gate driving circuit 212 to conduct the transistors Q1 and Q2. Similarly, the power control module 206 appropriately controls the first voltage conversion circuit 201 and the second voltage conversion circuit 202 whether to perform operations according to the starting signal ST_a or a load voltage Vo_a of the source driving circuit 214, to combine the voltage conversion circuits with different features, to provide the power with stable voltage value to the gate driving circuit 212, rapidly, and to allow the source driving circuit 214 to charge the capacitors C1 and C2. Via the control of the power control module 206, the power conversion system 200 of the electronic device 20 can rapidly provide the power with stable voltage value to the load circuit 210, to control the panel components to display corresponding brightness.

Figure 3:
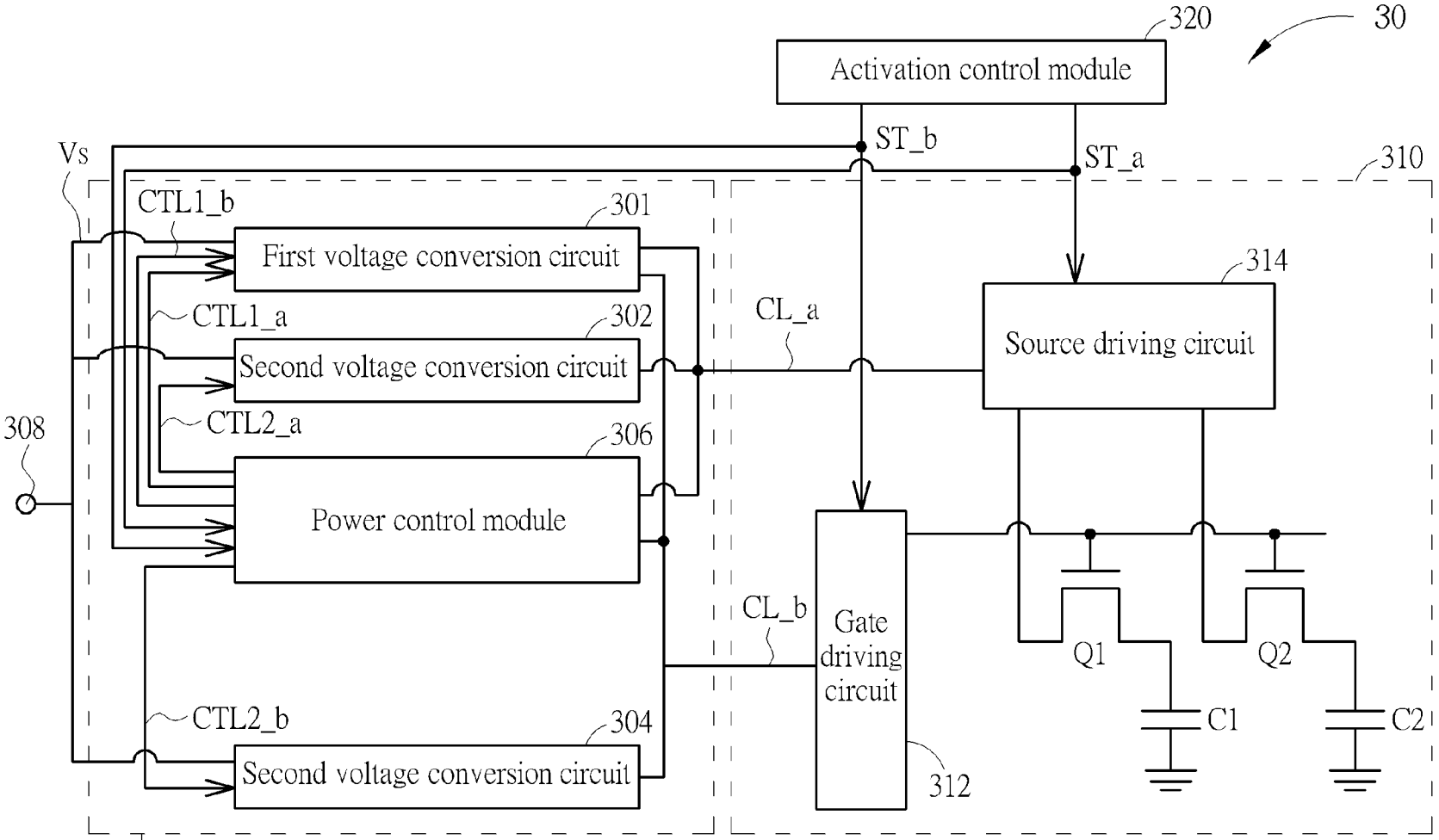
FIG. 3 is a schematic diagram of an electronic device according to still another embodiment of the present invention.

Moreover, please refer to FIG. 3 which is a schematic diagram of an electronic device 30 according to still another embodiment of the present invention. As shown in FIG. 3, the electronic device 30 comprises a power conversion system 300, a load circuit 310 and an activation control module 320. The power conversion system 300 comprises a first voltage conversion circuit 301, second voltage conversion circuits 302, 304 and a power control module 306. The load circuit 310 comprises a gate driving circuit 312, a source driving circuit 314, transistors Q1 and Q2 and capacitors C1 and C2. The connection relationships between the power conversion system 300, the load circuit 310 and the activation control module 320 are the same with those between the power conversion system 200, the load circuit 210 and the activation control module 220, and are not narrated herein for brevity.

In comparison with the power conversion system 200, the first voltage conversion circuit 301 of the power conversion system 300 generates the required voltages of the gate driving circuit 312 and the source driving circuit 314, simultaneously, and outputs the required voltages to the source driving circuit 314 and the gate driving circuit 312 via the circuit wires CL_a and CL_b. In the electronic device 30, the combination of the first voltage conversion circuit 301 and the second voltage conversion circuit outputs the converted voltage to the source driving circuit 314 via the circuit wire CL_a and the combination of the first voltage circuit 301 and the second voltage conversion circuit 304 outputs the converted voltage to the gate driving circuit 312 via the circuit wire CL_b. The activation control module 320 generates the starting signals ST_b and ST_a according to the scan line signals and data line signals of the electronic device 30, respectively, to control the gate driving circuit 312 and the source driving circuit 314 to conduct the transistors Q1 and Q2 and charge the capacitors C1 and C2 to the voltages corresponding to the display data, so as to control the electronic device 30 to display the corresponding brightness.

Figure 4A:
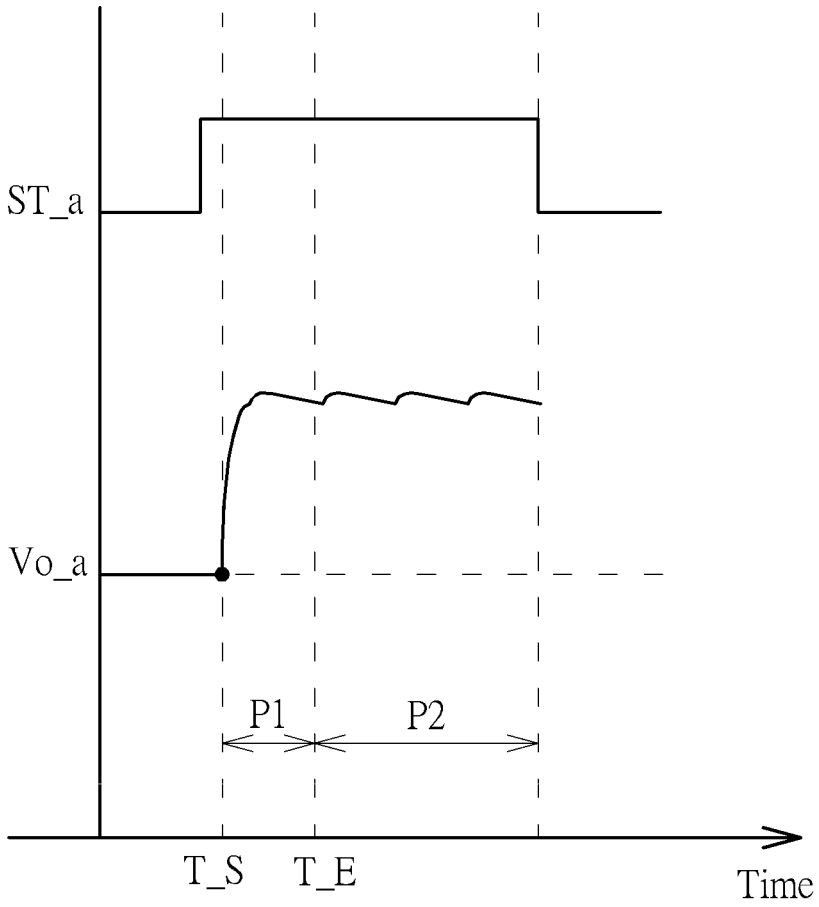
FIGS. 4A-4D are timing diagrams of a starting signal and a load voltage shown in FIG. 2.
Figure 4B:
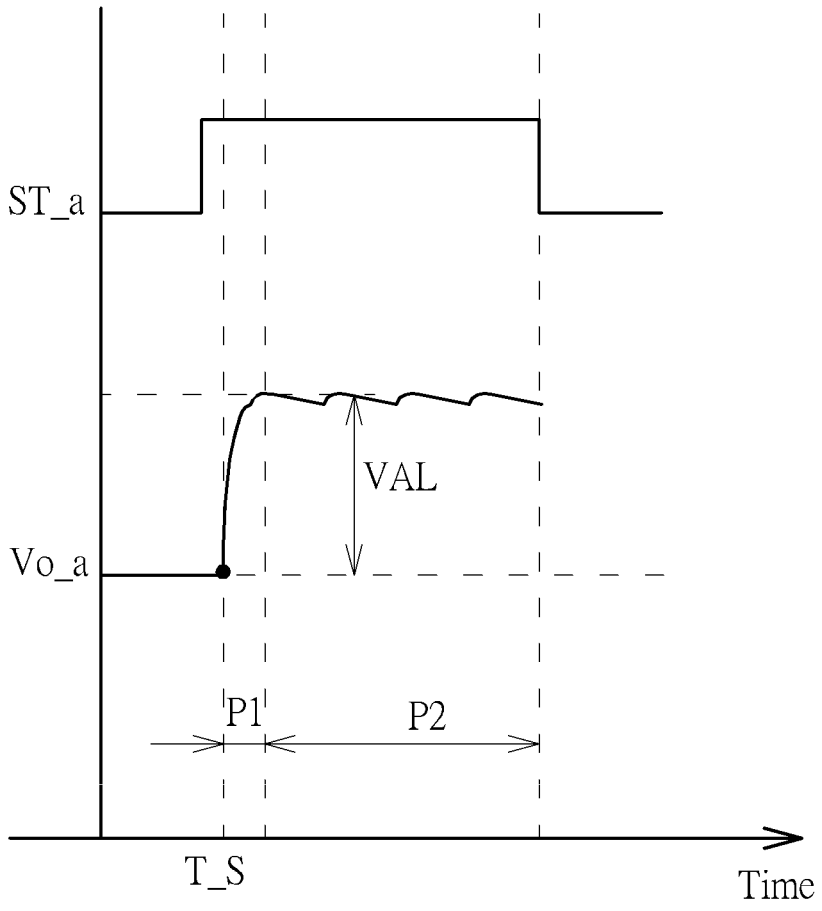
Figure 4C:
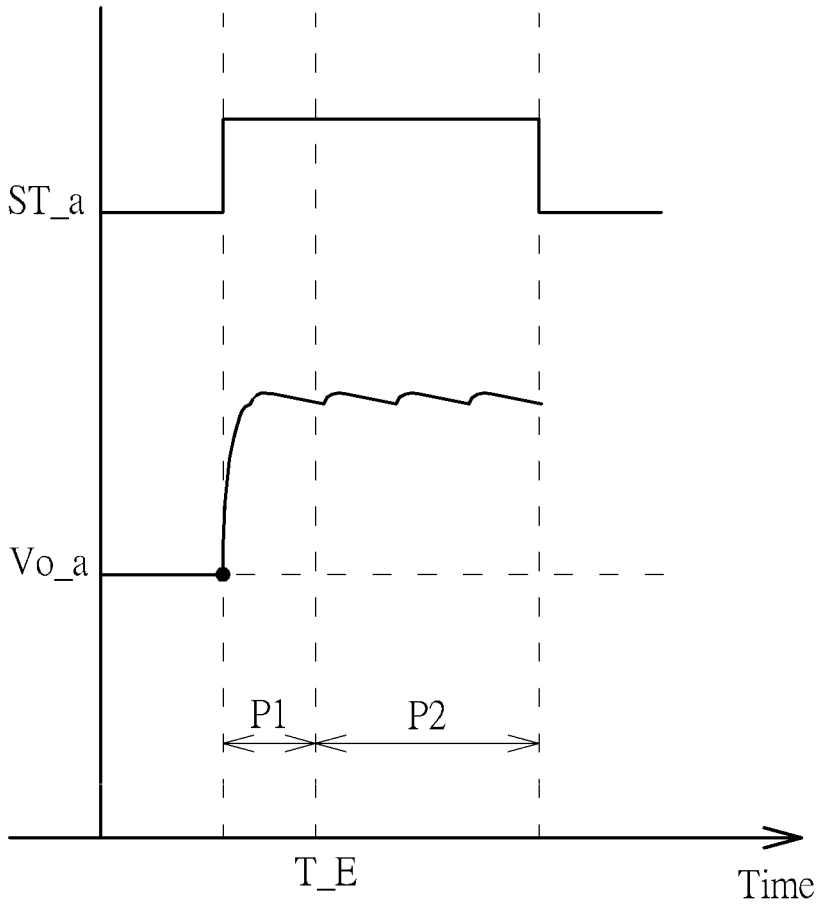
Figure 4D:
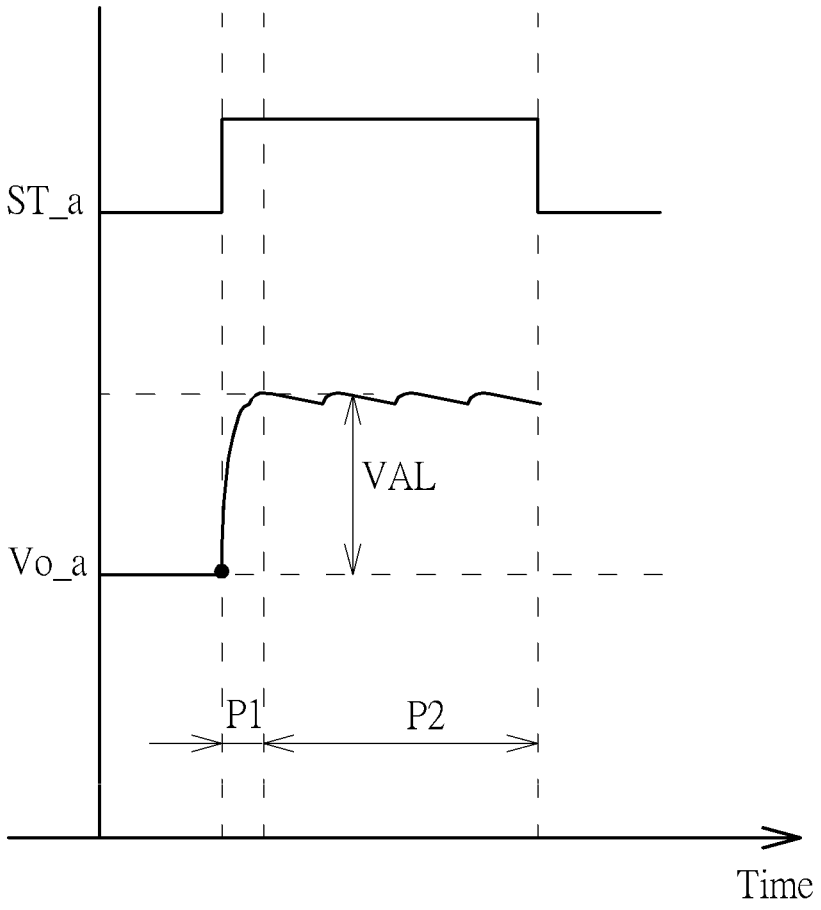

Moreover, please refer to FIGS. 4A-4D, which are timing diagrams of the starting signal ST_a and the load voltage Vo_a shown in FIG. 2. In FIG. 4A, the power control module 206 appropriately control the first voltage conversion circuit 201 to start performing the operations at the time T_S according to the starting signal ST_a, controls the first voltage conversion circuit 201 to stop performing the operations at the time T_E and controls the second voltage conversion circuit 202 to start performing the operations before the time T_E. In FIG. 4B, the power control module 206 appropriately controls the first voltage conversion circuit 201 to start performing the operations at the time T_S according to the starting signal ST_a. When the voltage value of the load voltage Vo_a is greater than the predetermined value VAL, the power control module 206 controls the first voltage conversion circuit 201 to stop performing the operations and controls the second voltage conversion circuit 202 to start performing the operations before the first voltage conversion circuit 201 stops performing the operations. In FIG. 4C, when the power control module 206 determines the voltage value of the load voltage Vo_a is smaller than the predetermined value VAL (when the starting signal ST_a is at high voltage level and the load voltage Vo_a is 0 in the beginning), the power control module 206 controls the first voltage conversion circuit 201 to start performing the operations. The power control module controls the first voltage conversion circuit 201 to stop performing the operations at the time T_E and controls the second voltage conversion circuit 202 to start performing the operation before the time T_E. In FIG. 4D, when determining the voltage value of the load voltage Vo_a is smaller than the predetermined value VAL, the power control module 206 controls the first voltage conversion circuit 201 to start performing the operations. When the voltage value of the load voltage Vo_a is greater than the predetermined value VAL, the power control module 206 controls the first voltage conversion circuit 201 to stop performing the operations and controls the second voltage conversion circuit 202 to start the performing operations before the first voltage conversion circuit stops the performing operations.

In FIGS. 4A-4D, the power control module 206 appropriately combines different features of the first voltage conversion circuit 201 and the second voltage conversion circuit 202, to make the load circuit 210 receives the converted voltages of the first voltage conversion circuit 201 and the second voltage conversion circuit 202 simultaneously within the period P1, such that the current received by the load circuit 210 becomes greater and the voltage value of the load voltage Vo_a can be increased quickly. The load circuit 201 receives the voltage which is outputted by the second voltage conversion circuit 202 and has more stable voltage within the period P2, such that the voltage value of the load voltage Vo_a becomes more stable (i.e. the ripple of the load voltage Vo_a becomes smaller).

The power conversion system of the present invention uses the starting signal used for activating the load circuit or the voltage value of the load voltage after the load circuit has activated as the references of determining the first voltage conversion circuit and the second voltage conversion circuit whether to perform the operations, to combine the two voltage conversion circuit, so as to quickly provide the power with stable voltage value to the load circuit. According to different application, those with ordinary skill in the art may observe appropriate alternations and modifications. For example, the power conversion system of the above embodiments controls the first voltage conversion circuit whether to perform the operations at the appropriate time after the load circuit has been activated or according to the magnitude of the load voltage. In other embodiments, the power control module may determine the first voltage conversion circuit whether to perform operations at the appropriate time after the load circuit has been activated and according to the magnitude of the load voltage simultaneously. For example, the power control module 206 determines whether the voltage value of the load voltage is greater than the predetermined value VAL at the appropriate time after the load circuit has been activated, and then accordingly controls the first voltage conversion circuit whether to stop performing operations. All methods of determining the first voltage conversion circuit whether to perform the operations according to the timings related to the operations of the load circuit or the magnitude of the load voltage belong to the scope of the present invention, and can be accordingly changed without being limited herein.

Moreover, the power conversion system of the above embodiments controls the two voltage conversion circuits whether to perform the operations, to combine different features of the two voltage conversion circuits and to rapidly provide power with stable voltage value to the load circuit. In other embodiments, the power conversion system may only control the first voltage conversion circuit whether to perform the operations, the second voltage conversion circuit is not controlled by the signals and constantly convers the input voltage of the power source terminal to the required voltage of the load circuit, so as to combine the two voltage conversion circuits and to rapidly provide power with stable voltage value to the load circuit. In addition, the power conversion system of other embodiments may control three or multiple voltage conversion circuit whether to perform the operations, to combine different features of the three or multiple voltage conversion circuits and to rapidly provide power with stable voltage value to the load circuit. The number of the voltage conversion circuits controlled by the power control module in the power conversion system can be accordingly altered and is not limited herein.

To sum up, the prior art only configures a single kind of the voltage conversion circuit to provide the power required by the internal load circuit and is limited by the feature of the single kind of voltage conversion circuit, resulting that the voltage conversion system cannot rapidly output the power, which is workable and has stable voltage value, to the load circuit. The present invention combines the voltage conversion circuit with different features and allows the voltage conversion system to rapidly provide the power with stable voltage value to the load circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power conversion system in an electronic device, for converting an input voltage of a power source terminal to a required voltage of a load circuit to provide power to the load circuit, the power conversion system comprising:

a first voltage conversion circuit, coupled to the power source terminal for converting the input voltage to the required voltage of the load circuit according to a first control signal; and a power control module, coupled to the first voltage conversion circuit and the load circuit for generating the first control signal according to a starting signal turning on the load circuit or a load voltage of the load circuit;

wherein the load circuit is coupled to the first voltage conversion circuit, receives the voltage outputted from the first voltage conversion circuit to perform operations, and outputs the load voltage to the power control module.

2. The power conversion system of claim 1, wherein the electronic device is a display panel device and the load circuit comprises a driving circuit and a display component of the display panel device.

3. The power conversion system of claim 1 further comprising:

a second voltage conversion circuit, coupled to the power source terminal for converting the input voltage to the required voltage of the load circuit;

wherein the load circuit is coupled to the first voltage conversion circuit and the second voltage conversion circuit, receives the voltages outputted from the first voltage conversion circuit and the second voltage conversion circuit, and outputs the load voltage to the power control module.

4. The power conversion system of claim 3, wherein the first voltage conversion circuit is a voltage conversion circuit of inductor type and the second voltage conversion circuit is a voltage conversion circuit of capacitor type.

5. The power conversion system of claim 3, wherein the second voltage conversion circuit is not controlled by signals and constantly converts the input voltage to the required voltage of the load circuit.

6. The power conversion system of claim 3, wherein the second voltage conversion circuit is coupled to the power control module for converting the input voltage to the required voltage of the load circuit according to a second control signal generated by the power control module.

7. The power conversion system of claim 6, wherein the first control signal generated by the power control module is utilized for controlling the first voltage conversion circuit whether to perform operations, i.e. whether to output the converted voltage to the load circuit, and the second control signal generated by the power control module is utilized for controlling the second voltage conversion circuit whether to perform operations, i.e. whether to output the converted voltage to the load circuit.

8. The power conversion system of claim 7, wherein the power control module controls the second voltage conversion circuit to perform the operations before controlling the first voltage conversion to stop performing the operations.

9. The power conversion system of claim 7, wherein when the starting signal has not activated the load circuit, the power control module controls the second voltage conversion circuit not to perform the operations via the second control signal; and when the starting signal has activated the load circuit, the power control module controls the second voltage conversion circuit to start performing the operations before controlling the first voltage conversion to stop performing operations.

10. The power conversion system of claim 7, wherein the power control module controls the second voltage conversion circuit to start performing the operations via the second control signal when determining the voltage value of the load voltage is greater than a predetermined value.

11. The power conversion system of claim 1, wherein when the starting signal has not activated the load circuit, the power control module controls the first voltage conversion circuit not to perform the operations via the first control signal; and when the stating signal has activated the load circuit, the power control module controls the first voltage conversion circuit to start performing the operations via the first control signal at a first turn-on time and the power control module controls the first voltage conversion circuit to stop performing the operations via the first control signal at a first turn-off time after the first voltage conversion circuit starts performing operations.

12. The power conversion system of claim 1, wherein when the starting signal has not activated the load circuit, the power control module controls the first voltage control circuit not to perform the operations via the first control signal; and when the starting signal has activated the load circuit, the power control module controls the first voltage conversion circuit to start performing the operations via the first control signal at a first turn-on time and the power control module controls the first voltage conversion circuit to stop performing operations via the first control signal when determining the voltage value of the load voltage is greater than a predetermined value.

13. The power conversion system of claim 1, wherein when the starting signal has not activated the load circuit, the power control module controls the first voltage control circuit not to perform the operations via the first control signal; and when the starting signal has activated the load circuit, the power control module controls the first voltage conversion circuit to start performing the operations via the first control signal when determining the voltage value of the load voltage is not greater than a predetermined value and the power control module controls the first voltage conversion circuit to stop performing operations via the first control signal at a first turn-off time after the first voltage conversion circuit starts performing operations.

14. The power conversion system of claim 1, wherein when the starting signal has not activated the load circuit, the power control module controls the first voltage control circuit not to perform the operations via the first control signal; and when the starting signal has activated the load circuit, the power control module controls the first voltage conversion circuit to start performing the operations via the first control signal when determining the voltage value of the load voltage is not greater than a predetermined value and the power control module controls the first voltage conversion circuit to stop performing operations via the first control signal when determining the voltage value of the load voltage is greater than the predetermined value after the first voltage conversion circuit starts performing operations.

* * * * *